US005215403A

United States Patent [19]

Peterson

[11] Patent Number: 5,215,403

[45] Date of Patent: Jun. 1, 1993

[54] MACHINE FOR TRANSFERRING PAVING MATERIAL

[75] Inventor: Howard J. Peterson, Grass Valley, Calif.

[73] Assignee: A. C. Dike Company, Lincoln, Calif.

[21] Appl. No.: 853,218

[22] Filed: Mar. 18, 1992

[51] Int. Cl.[5] ..... E01C 19/12; E01C 19/18; E01C 19/20; B60S 9/00

[52] U.S. Cl. ..... 404/101; 404/108; 239/672; 280/111

[58] Field of Search ..... 404/83, 84.5, 84.2, 404/101, 108, 109, 110; 280/111, 6.11; 239/672, 687

[56] References Cited

U.S. PATENT DOCUMENTS

| | | | |
|---|---|---|---|
| 3,456,566 | 7/1969 | Lazaro | 404/108 |
| 4,540,312 | 9/1985 | Allen | 404/108 X |
| 4,801,218 | 1/1989 | Musil | 404/101 X |
| 4,830,533 | 5/1989 | Miller | 404/110 X |
| 4,934,864 | 6/1990 | Maudlin | 404/108 |

*Primary Examiner*—Terry Lee Melius

*Assistant Examiner*—Nancy P. Connolly

*Attorney, Agent, or Firm*—Lothrop & West

[57] ABSTRACT

A three-wheeled machine carries a hopper positioned to receive paving material from a dump truck immediately in front of the machine, the hopper being emptied by a conveyor oriented transversely to the path of the machine. A left front wheel, a left rear wheel and a right side wheel support the machine and are so connected to the machine and to actuating mechanisms as to lift or lower the left and right sides of the machine in a selective manner, and thereby enable the machine to be elevated or lowered in level fashion, or to be inclined either toward the left or toward the right. The left rear wheel and the right wheel are independently driven and thus afford "skid steer" capability. Of particular interest is the construction and operation of the left rear wheel which selectively enables it to be moved not only up and down but also in a fore and aft direction between a retracted position, for compactness while the machine is being transported, and a projected position, for maximum stability of the machine while being operated.

4 Claims, 7 Drawing Sheets

FIG-4
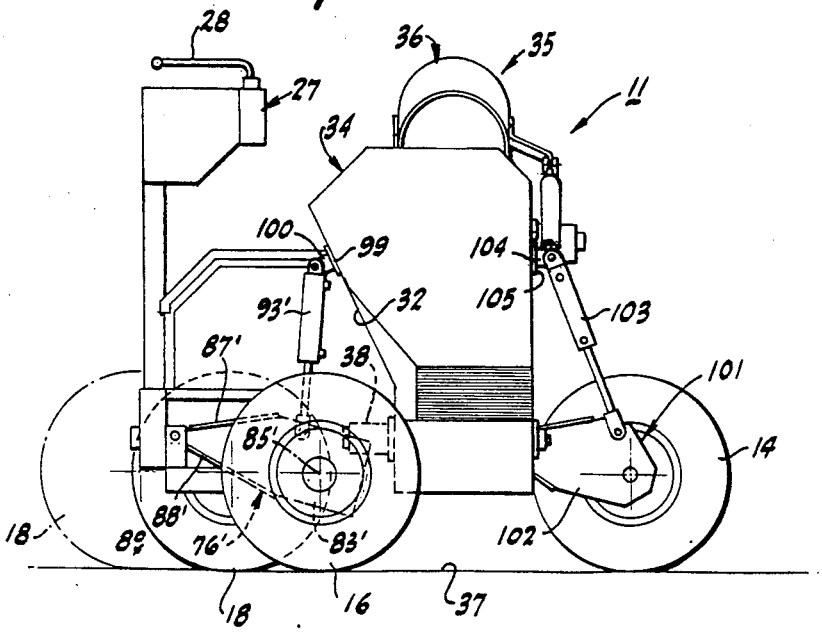
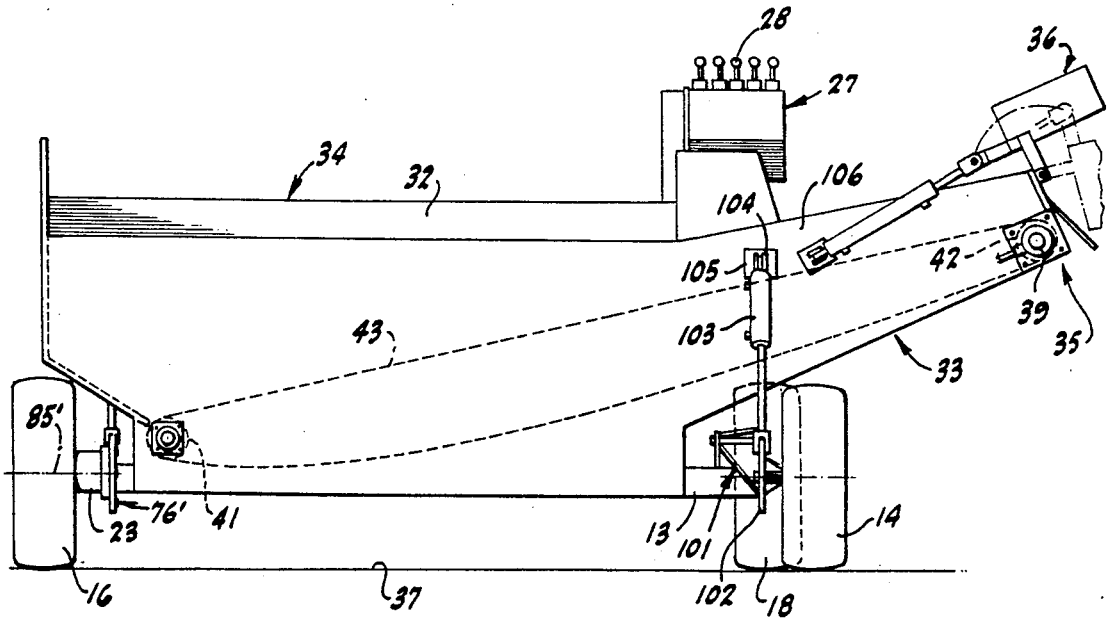
FIG-5

MACHINE FOR TRANSFERRING PAVING MATERIAL

BACKGROUND OF THE INVENTION

The invention relates to a self-propelled machine used in the construction and repair of roads, curbs and the like.

The machine receives road-base rock, asphalt, gravel and other road building materials from a dump truck and is capable of transferring the material laterally while moving ahead with the truck for immediate application to the roadbed or for shoulder work, filling trenches, patching or feeding curb machines; or it can be used to store the unloaded material in its own hopper and transport the material to a remote location for application as needed. The machine is self-propelled and supported by three ground engaging wheels. All the wheels are always in engagement with the ground and are suspended so that the frame can be tilted if and as required by the terrain. One of the wheels can also be shifted from a forward, retracted position, for compactness in transporting the machine to another job site, to an after, projected position, providing optimum machine stability in operation.

A customary search turned up the following U.S. Pat. Nos.: t,0030

Although some of the features of the present machine find their counterparts in a piecemeal fashion in the prior art, such as valve-controlled hydraulic pumps and motors for driving the wheels as well as adjustment means providing selective elevation of the wheels, as disclosed in Mauldin, U.S. Pat. No. 4,934,864, the overall construction and operation of applicant's machine is neither anticipated by nor rendered obvious by the six patents, taken either distributively or in combination.

Of especial interest is the unique capability of the left rear wheel of the present machine to perform multiple functions. Among these is the ability to lift or lower the adjacent portion of the frame, plus propelling or retarding the movement of the left side of the frame in advancing or "skid-steering" the machine plus changing the "footprint" of the machine between a larger "footprint" to provide stability in use and a smaller "footprint" for compactness in transporting the machine from place to place. Applicant knows of no such multiple capabilities in any prior art machine.

SUMMARY OF THE INVENTION

A three-wheeled, self-propelled vehicle includes a transversely elongated hopper positioned to receive paving material from a dump truck and a belt conveyor for transferring the material from the hopper immediately or subsequently at another location. Two of the three wheels are independently powered and all three of the wheels are always in contact with the ground. Each wheel is also individually suspended and can be moved up and down to adjust the machine's position to conform to the terrain or to a special dump truck height or to high center curbs or other particular height or slope conditions. One of the wheels can also be extended in a rearward direction to enhance the stability of the machine yet can be retracted for ease in fitting the machine onto a transport vehicle.

BRIEF DESCRIPTION OF THE DRAWING FIGURES

FIG. 4 is a right side elevational view thereof;

FIG. 5 is a front elevational view thereof;

DETAILED DESCRIPTION OF A PREFERRED EMBODIMENT

Figure 1:
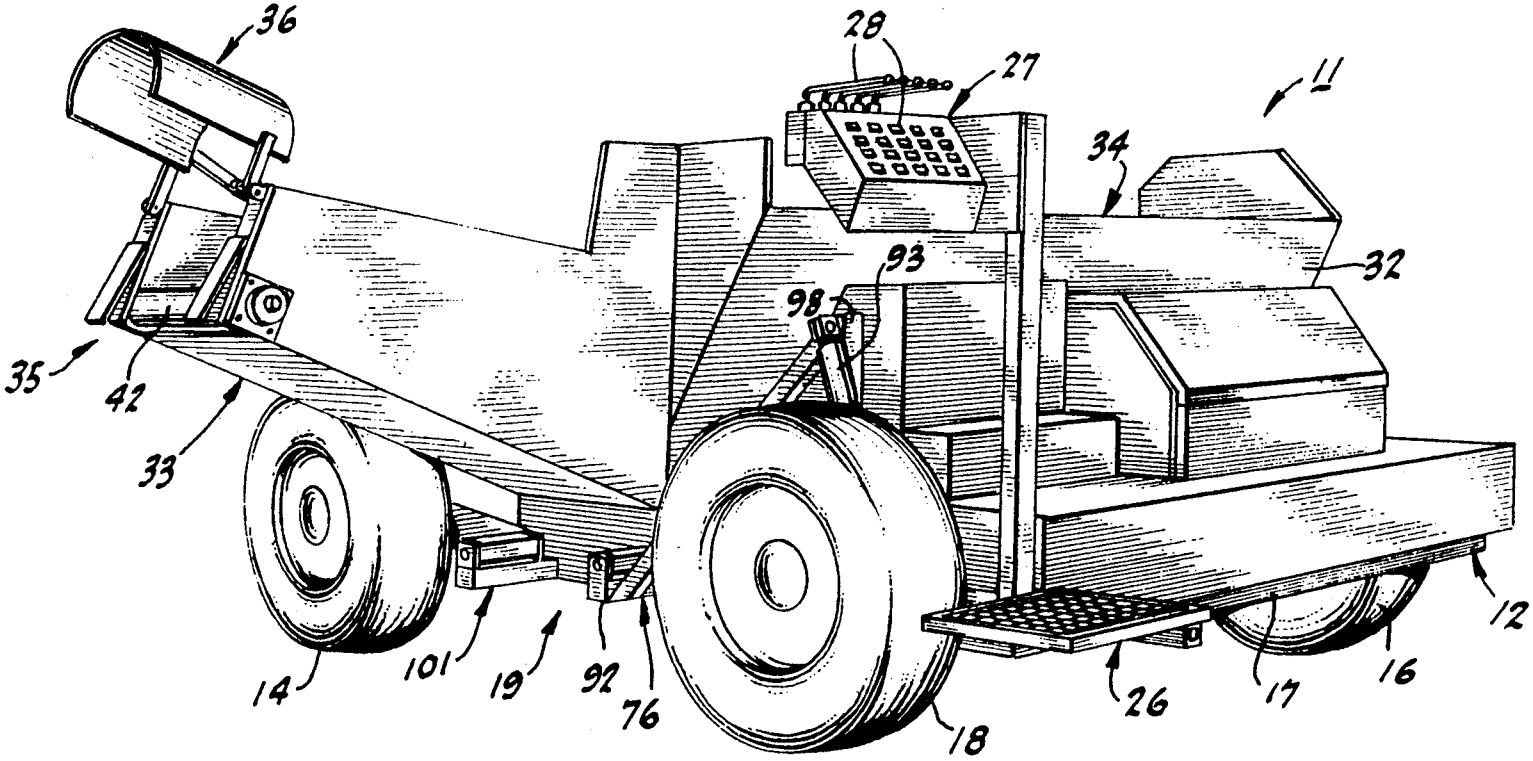
FIG. 1 is a left rear perspective view of the machine showing all three wheels at the same height and the left rear wheel retracted to the position assumed while the machine is being transported from job site to job site, with certain conventional portions of the machine, such as the towing connection, being omitted or simplified for greater clarity of disclosure.

While the machine of the invention is capable of being incorporated in numerous different physical embodiments, depending upon the environment and requirements of use, it has successfully been made and tested in the embodiment disclosed herein.

The machine of the present invention, generally designated by the reference numeral 11 includes a transversely elongated frame 12, supported on its forward, leading end 13 by a left-front wheel 14 and a right wheel 16 preferably located somewhat closer to the rear of the machine than to the front thereof.

The rear or after or trailing end 17 of the frame 12 is supported partially by the right wheel 16 and partially by a wheel 18 located on the left-rear corner of the frame 12. It is the construction and operation of the left rear wheel 18 and its attendant elements that are of particular interest in the present application.

The frame 12 includes in addition to the front end 13 and the after end 17, a left-hand side 19 and a right-hand side 21.

Since the right wheel 16 and the left rear wheel 18 are individually driven, as by respective hydrostatic motors 23 and 24; and since all three wheels are always in contact with the ground, a nice degree of speed and direction control is afforded to an operator (not shown) located on the operator's platform 26 positioned adjacent the left-rear wheel 18.

Conveniently arranged on an instrument control panel 27 at the operator's station is a plurality of buttons, toggle switches, levers and indicator lights. These control devices are of a conventional type and are therefore not disclosed in detail although they are generally designated by the reference numeral 28.

The machine is self-propelled but its control system allows the two power wheels to be placed in a free-wheeling mode, when the machine is being towed. Additionally, each of the two power wheels 16 and 18 has its respective, control mechanism, thereby providing reliable skid steer capabilities.

A prime mover 31, mounted centrally on the back end of the frame 12, is preferably an internal combustion engine, such as an air-cooled diesel engine.

The engine 31 not only provides the power for the two wheels 16 and 18 and other machine elements; it also provides the power for an elongated belt conveyor 33, or the like, mounted on the forward portion of the frame 12 and oriented transversely to the path of the machine.

The belt conveyor 33 is located in a transversely elongated hopper 34 on the forward end of the machine, the top of the back wall 32 of the hopper 34 being sloped and being high enough to intercept and direct downwardly and forwardly onto the belt conveyor 33, all the material transferred from the dump truck (not shown).

The conveyer 33 is positioned in the hopper 34 in such a way as to carry upwardly and toward the left-hand side 19 of the machine any of various types of paving material, deposited in the hopper by the dump truck located just forward of the machine as the truck advances along its path and material transfer takes place in a rearward direction from truck to hopper.

The belt conveyor 33 picks up material from the hopper 34 and releases the material into a discharge head 35, including a pivoted ram-actuated deflector 36, located outboard of the left-hand side 19 of the machine, the paving material being thereby directed to the roadbed or other surface 37 below the discharge head.

In order to actuate the conveyor 33, a head drive motor 38 and a tail drive motor 39 are utilized, the drive motors being connected to a respective head pulley 41 and tail pulley 42 about which an endless belt 43 is trained.

Figure 10:
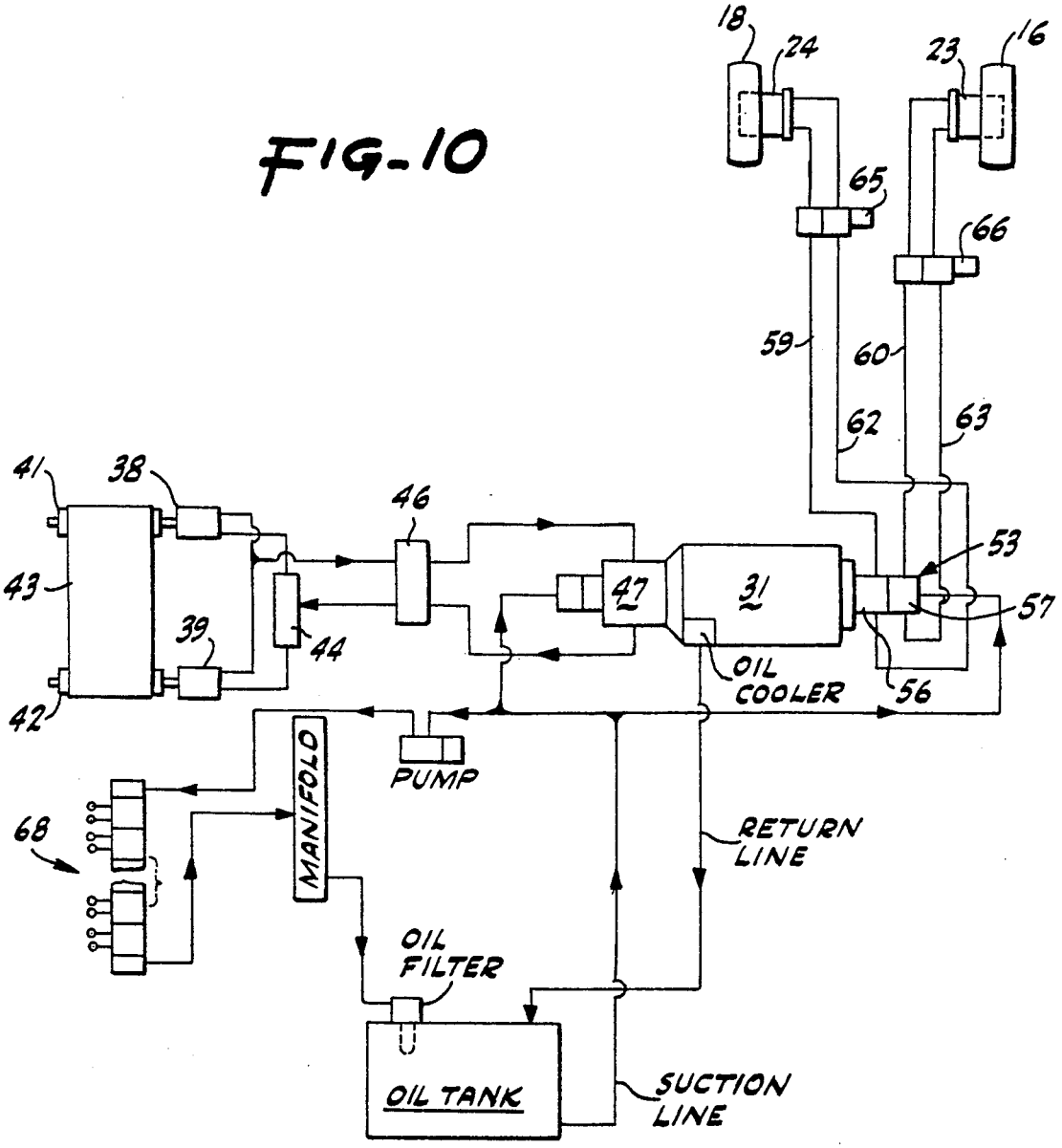

The belt drive motors 38 and 39 can be of any conventional make and are hydraulically connected through hoses to a suitable flow divider/combiner 44 (see FIG. 10) and a composite valve block 46, to a conventional hydrostatic drive 47, or hydraulic pump, attached to the shaft of the engine 31.

As previously described, the two wheels, right wheel 16 and left rear wheel 18, are independently powered. The right wheel motor 23, is mounted coaxially with the rotational axis of the right wheel 16 and serves as a hub for the right wheel 16. In similar manner, the left rear wheel motor 24 serves as a hub for the left rear wheel 18.

The wheel motors 23 and 24 are driven in a manner somewhat comparable to the arrangement previously described in relation to the two belt drive motors 38 and 39. In other words, the wheel motors 23 and 24 are hydraulically connected to a hydrostatic drive 53 mechanically connected to the engine 31.

The hydrostatic drive 53 comprises two hydraulic pump portions 56 and 57 having high pressure lines 59 and 60, respectively, leading to the left rear wheel motor 24 and to the right wheel motor 23. Return lines 62 and 63 lead from respective wheel motors 24 and 23 to the pump portions 56 and 57, respectively.

Interposed in the lines 59 and 62 and in the lines 60 and 63 are free wheel actuators 65 and 66, respectively. When energized, the free wheel actuators place the wheel drive motors 23 and 24 in free wheel mode, such as would be used in the event the machine is to be towed, as by a dump truck during the course of transferring paving material from the truck to the machine's hopper 34.

Also interposed in the hydraulic circuit is a valve block 68 comprising a plurality of valves, which are solenoid-controlled, for example, from the control panel 27 and, among other functions, enables the operator to actuate each of the drive wheels 16 and 18 independently, to effect lifting and lowering of all three wheels 14, 16 and 18 and to shift the left rear wheel 18 longitudinally, as required.

The component valves, motors, pumps etc. of the foregoing hydraulic structure and their manner of operation are well known in the art and a further detailed disclosure of these elements is believed to be unnecessary. For the same reason, conventional although important, accessories such as oil coolers, filters, manifolds and tanks, or reservoirs connected to suction and return lines, are neither shown nor described in detail since any person acquainted with the art would readily be able to incorporate such components successfully in the system without further teaching.

As can be seen from the foregoing, the operator is able to actuate each of the two drive wheels 16 and 18 individually. This capability readily enables the operator to "skid steer" the machine in well-known manner.

If need be, the machine can be towed by putting it in free wheel mode by energizing the free wheel actuators 65 and 66 (see FIG. 10); or it can be used either to push the dump truck or another vehicle or used as an independent material-hauling vehicle capable of receiving a large load of paving material and transporting, in its hopper, carrying the material to any desired location and quickly unloading the material by actuating the conveyor 33.

One of the major uses to which the present embodiment of the machine is put is the rapid and efficient transfer of material, such as a 12 ton load of asphalt, gravel or base rock material received in its hopper from a dump truck while moving forwardly in unison with the dump truck, and unloading the entire load of material to the side in less than four minutes.

Figure 6:
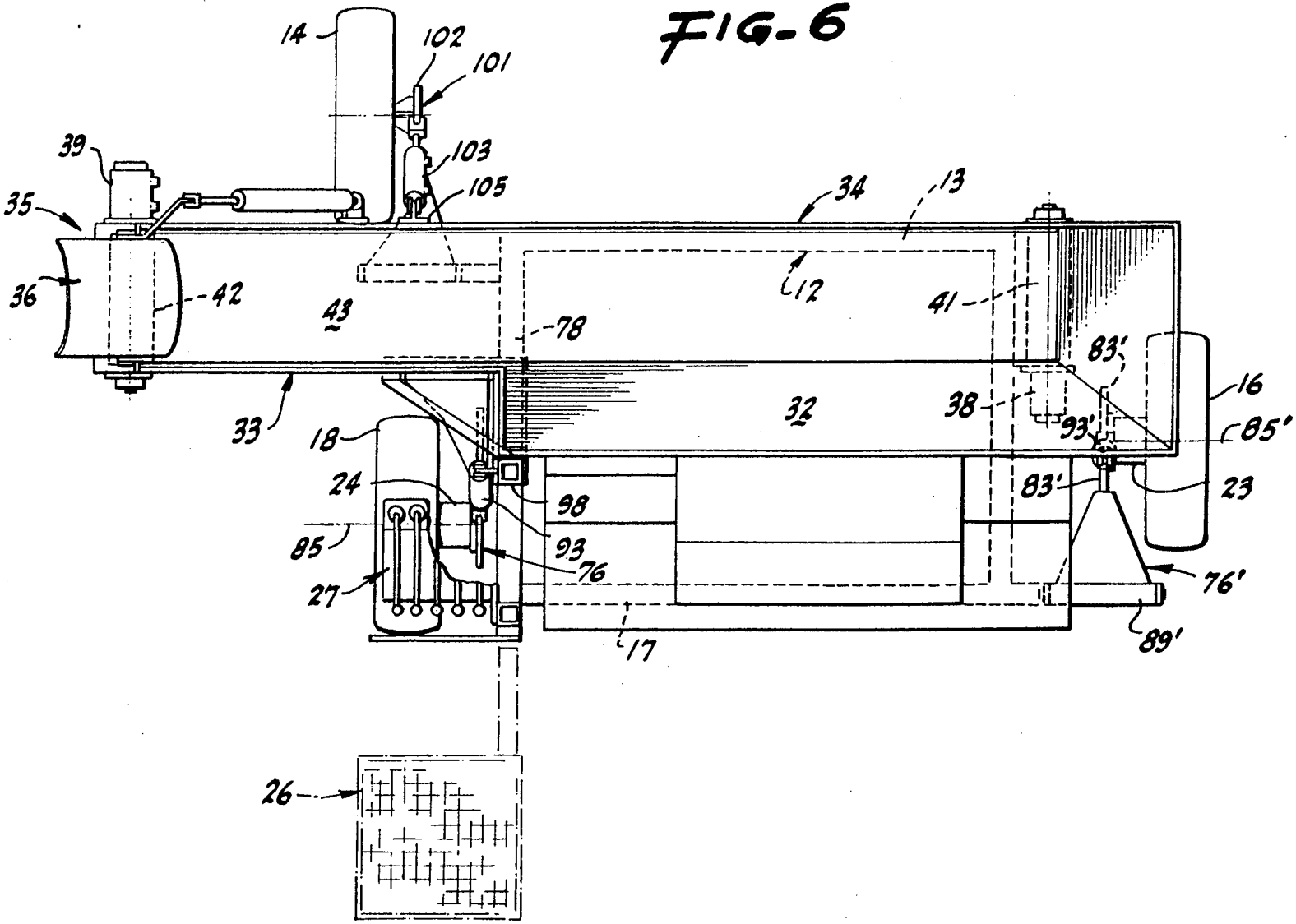
FIG. 6 is a top plan view thereof.

A principal benefit of the machine is its compact size. Its "footprint" is relatively small, thereby enabling it to be hauled from job site to job site in a comparatively small transport vehicle. Loading and unloading the machine onto and off the transport vehicle is facilitated by the use of a pair of detachable ramps (not shown) leading from the ground to the bed of the transport vehicle. To load or unload the machine onto the bed or off the bed, it is merely necessary for the operator to stand on the operator's platform 26 and manipulate the appropriate drive wheel controls on the control panel 27 in order to move the machine up or down on the twin ramps. The platform 26 is removable (see FIG. 6).

Figure 2:
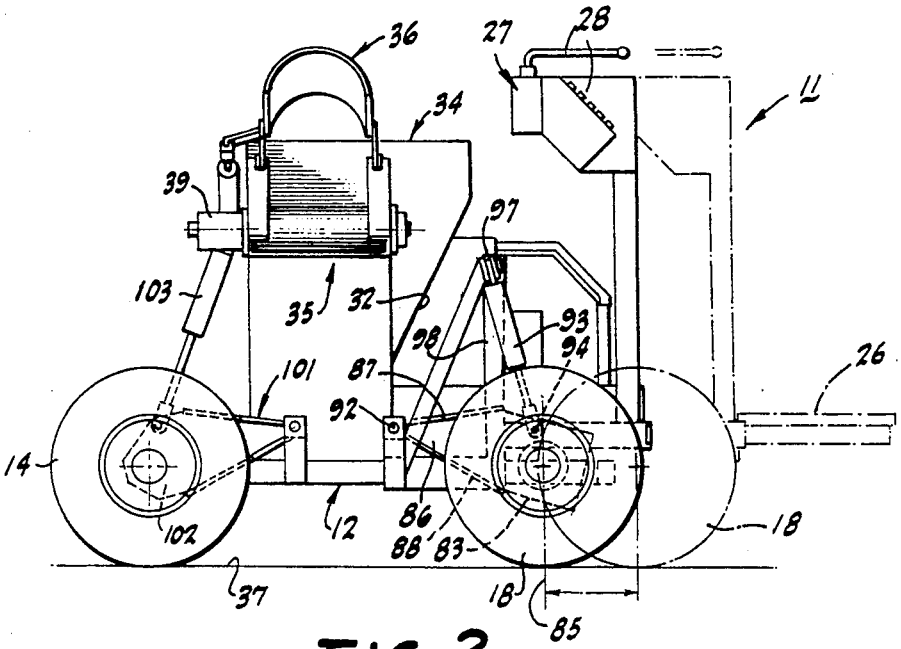
FIG. 2 is a left side elevational view thereof, largely in profile but showing the left rear wheel in full line in base, or retracted position, and in broken line in rearwardly extended position.
Figure 3:
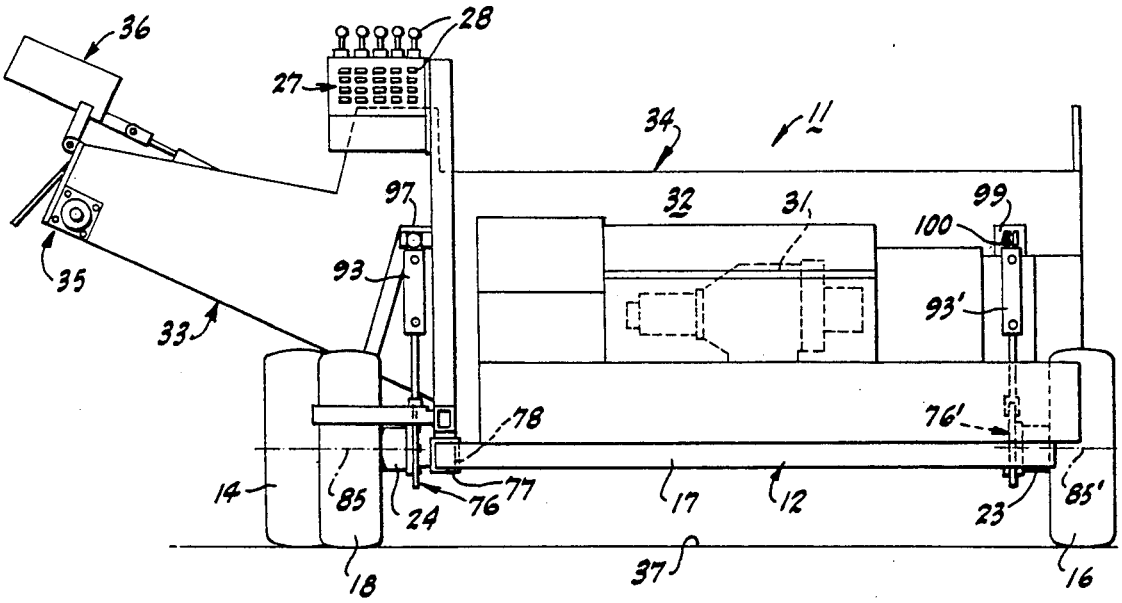
FIG. 3 is a rear elevational view thereof.

To provide additional stability to the machine, once it has been unloaded from the transport vehicle at the job site, the left rear wheel 18 can be extended rearwardly approximately a foot (see FIGS. 2 and 4). The longer wheelbase provided by such an extension of the left rear drive wheel 18 results in an enlarged "footprint" on the ground and even greater stability during operation of the machine. Yet, when the job is completed and it is time to load the machine onto the bed of the transport vehicle, the left rear wheel 18 can be retracted and the machine moved, under its own power, up the ramps and onto the bed in transverse orientation on the bed. With the left rear wheel in retracted position and the platform removed, the machine fits on the bed of the transport vehicle well within highway load-width requirements.

Figure 7:
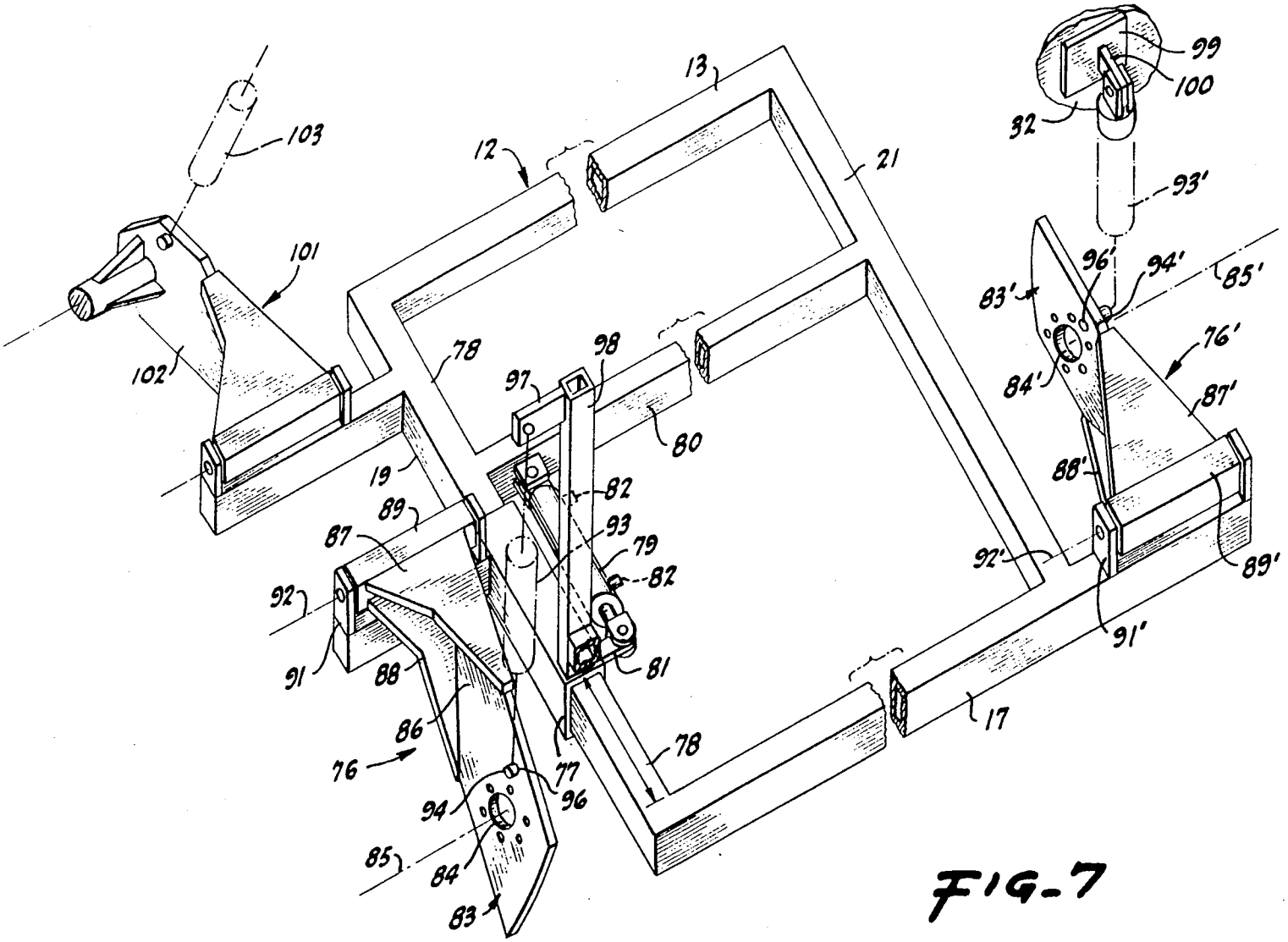
FIG. 7 is a fragmentary left rear perspective view of the main frame and attendant structure enabling the three wheels to be selectively raised and lowered and the left rear wheel to be rearwardly extended and forwardly retracted as well as elevated and lowered; the structure being shown in stylized and simplified form and with various elements broken away to clarify the disclosure.
Figure 8:
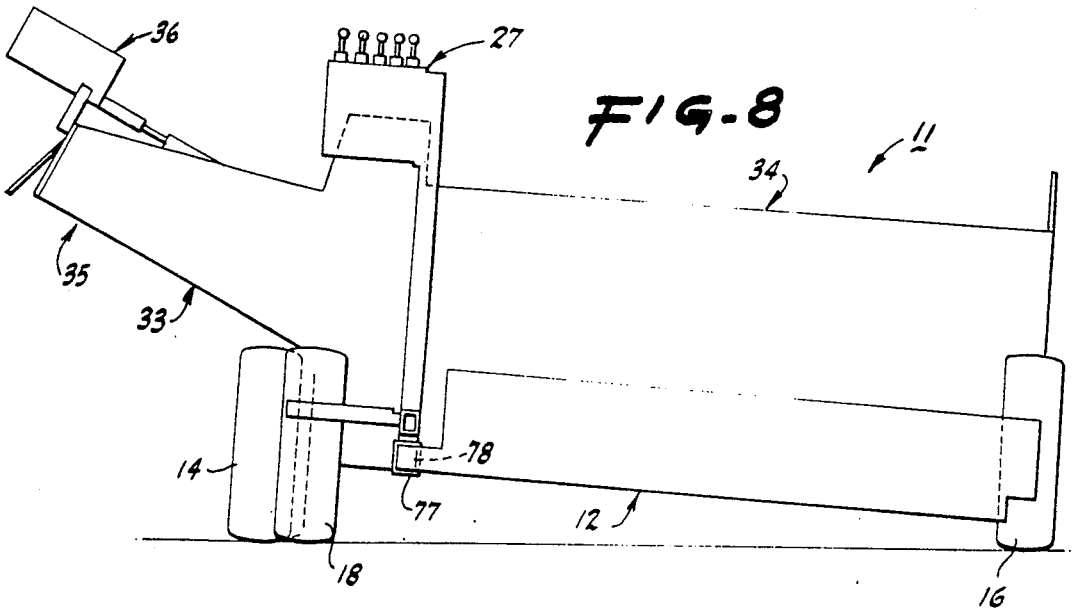
FIG. 8 is a rear elevational view, largely in profile, showing the machine tilted toward the right.
Figure 9:
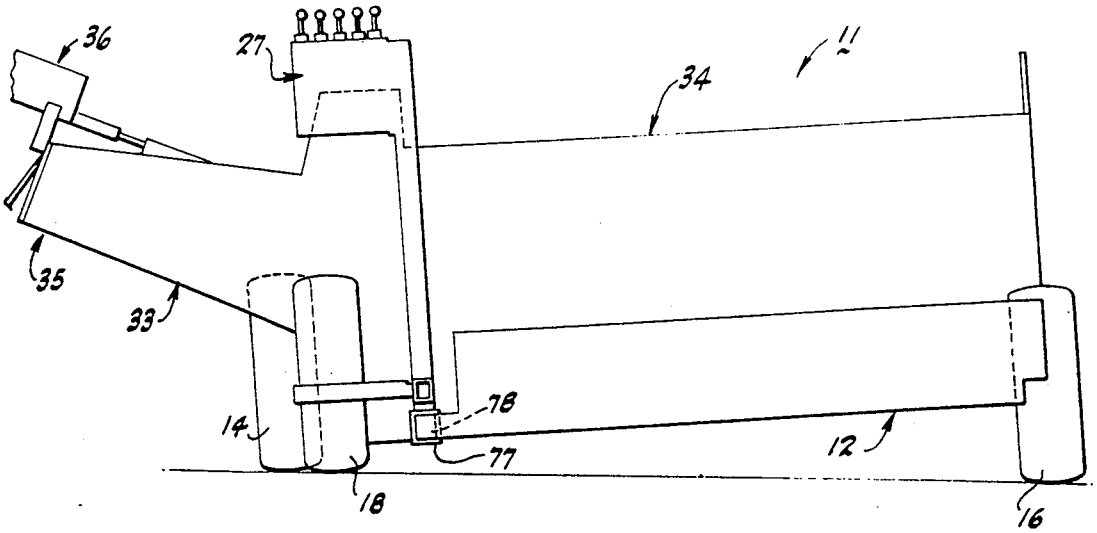
FIG. 9 is a view comparable to FIG. 8 but with the machine tilted toward the left; and, FIG. 10 is a block diagram of the major hydraulic circuitry, simplified by the exclusion of various conventional components, such as individual valves, speed controls etc., for greater clarity of disclosure.

The structure utilized to extend and retract the left rear wheel 18 in a fore and aft direction includes a framework 76 (see FIG. 7) on which the left rear wheel motor 24 is mounted. The framework 76 includes a fore and aft, square in section sleeve 77 dimensioned so as to translate freely, when lubricated, on a square in section, fore and aft rail 78 forming the left-hand side of the frame 12 of the machine.

Fore and aft movement of the framework 76 carrying the left rear wheel 18 is provided by a ram 79 pivotally mounted on its forward end on a cross-beam 80 on the machine frame 12 and on its after end on a bracket 81 mounted on the sleeve 77. Fore and aft movement of the framework 76 and the left rear wheel 18 between extended and retracted positions is controlled from the control panel 27; and hydraulic fittings 82 on the ram 79 are connected by hoses through the appropriate valve to a hydraulic pump driven by the engine 31 in customary fashion.

The left rear wheel motor 24 and attendant left rear wheel 18 are coaxially mounted at the opening 84 on a fore and aft, vertically disposed plate 83 for rotation of the wheel about a transverse axis 85.

Upon arriving at a job site it is often found that the terrain or other physical conditions and constraints, such as high center curbs, lateral drop-offs and the like will require that for optimum performance, the machine be tilted laterally either up or down. In other cases, it may be necessary to elevate the whole machine (i.e. to lower all three wheels) in order to conform to the height of a particular dump truck.

Following is a description of the lifting and lowering structure of the left rear wheel 18. The tapered forward end 86 of the longitudinal plate 83 spans two forwardly converging, triangular plates, an upper plate 87 and a lower plate 88 having their forward ends mounted on a transverse bar 89 pivotally mounted on a U-shaped bracket 91 secured at its inner end to the slidable sleeve 77. The pivotal mounting allows the plate 83 carrying the wheel 18 to pivot about transverse axis 92; and up and down movement of the after end of the plate 83 carrying the wheel is effected by a generally vertical ram 93 pivotally mounted at its lower end on a clevis pin 94 extending through a hole 96 in the plate 83; and pivotally mounted at its upper end on an outward projection 97 on the upper end portion of a vertical stanchion 98 mounted on the top side of the sleeve 77. Thus, as can best be seen in schematic form in FIG. 7, the entire framework 76 (with wheel 18) can be translated in a fore and aft direction by actuation of the fore and aft ram 79; and the wheel 18 can be elevated and lowered, relative to the frame 12 by actuation of the vertical ram 93.

Lateral tilt or elevation of the present machine can readily be effected by providing somewhat similar structure enabling the left front wheel 14 and the right wheel 16 also to be lifted or lowered individually; or, stated in another way, enabling the wheels, which stay in contact with the ground, to elevate or lower the portion of the frame to which the respective wheels are connected.

As appears most clearly in FIG. 5 the left front wheel 14 is mounted on a framework 101, including a thick, vertical steel plate 102, for example, of a generally triangular shape in side elevation. The apex of the triangular plate 102 is pivotally attached to the clevis at the lower end of the plunger of a ram 103, the clevis at the upper end of the ram 103 being pivotally mounted on a bracket 104 attached to a pad 105 welded to the adjacent wall 106 of the conveyor structure. As before, hydraulic fittings on the ram and hoses, with suitable valves controlled from the control panel 27, are connected to a pump driven by the engine 31, all in conventional manner. By actuating the ram 103 and causing the ram plunger to project or retract, the left front corner of the machine is elevated or lowered, respectively.

The elevating and lowering structure on the right wheel 16 (see FIGS. 4 and 7) is somewhat similar to the structure described in connection with the left rear wheel 18; and comparable elements carry the same reference numerals as those utilized in describing the left rear wheel 18, but with the prime symbol. In order to elevate the right side of the machine, it is merely necessary, as before, to actuate the respective ram 93', pivotally mounted at its upper end on bracket 100 and pad 99 attached to wall 32, causing the ram plunger to project and lift the right side 21 of the main frame 12.

It can therefore be seen that I have provided a machine for transferring paving material that is versatile and is not only stable and quickly responsive in operation but also compact for convenient transfer from job site to job site, largely as a consequence of the multiple capabilities of the left rear wheel.

What is claimed is:

1. Machine for transferring paving material comprising:

a. a frame having a front end, a rear end, a left side and a right side,
   said frame including a fore and aft rail extending between said front end and said rear end;

b. a hopper mounted on said frame for the reception and temporary storage of paving material;

c. at least three wheels;

d. means for mounting each of said wheels on said frame wherein there is movement of said wheels between a first lower position relative to said frame and a second upper position relative to said frame;

e. means for mounting at least one of said wheels on said rear end of said frame wherein there is movement between a forwardly retracted position relative to said rear end of said frame and a rearwardly projected position relative to said rear end of said frame,
   said means for mounting said one of said wheels including a sleeve translatable on said rail for fore and aft movement, a fore and aft plate, means for mounting said plate on said sleeve wherein there is rotation of said plate about a transverse axis, means on said plate for rotatably mounting said one of said wheels, a first hydraulic ram mounted on said frame and connected to said sleeve, said first hydraulic ram being adapted to translate said sleeve, said plate, said wheel mounting means and said one of said wheels in a fore and aft direction, and a second hydraulic ram mounted on said sleeve and connected to said plate, said second hydraulic ram being adapted to elevate and lower said plate, said wheel mounting means and said one of said wheels; and, f. control means on said frame for selectively moving each of said wheels between said first lower position and said second upper position and for moving said one of said wheels between said forwardly retracted position and said rearwardly projected position.

2. A machine as in claim 1 in which each of said wheel mounting means includes a bracket supported by said frame, a bar pivotally mounted on said bracket for rotation about a transverse axis, lever means on each of said bars for rotatably mounting the respective one of said wheels; and in which said means for moving said wheels between said first position and said second position includes hydraulic rams pivotally mounted on said frame and pivotally connected to said lever means for urging said wheels downwardly and upwardly about the respective transverse axes in response to actuation of said control means.

3. A machine as in claim 2 in which said means for mounting at least one of said wheels on said rear end of said frame includes a sleeve translatably mounted on said frame for fore and aft movement, means for mounting said bracket on said sleeve, and a hydraulic ram pivotally mounted at one end on said frame and at the other end on said sleeve, said ram being oriented in a fore and aft direction so that said sleeve, said bracket and said one of said wheels are moved in a fore and aft direction when said ram is selectively actuated by said control means.

4. Machine for transferring paving material comprising:

a. a frame having a front end, a rear end, a left side and a right side;

b. a left front wheel;

c. means for mounting said left front wheel on said frame adjacent the left front portion of said frame wherein there is movement between a lower position and an upper position;

d. a right wheel;

e. means for mounting said right wheel on the right side of said frame wherein there is movement between a lower position and an upper position;

f. a left rear wheel;

g. means for mounting said left rear wheel on said frame adjacent the left rear portion of said frame wherein there is movement of said left rear wheel between a lower position and an upper position and between a forward retracted position and a rearward projected position;

h. first control means connected to said frame and to each of said wheels for selectively moving each of said wheels between said lower position and said upper position; and, i. second control means connected to said frame and to said left rear wheel for selectively moving said left rear wheel between said forward retracted position and said rearward projected position.

* * * * *